US009057490B2

(12) United States Patent
Sharrah et al.

(10) Patent No.: US 9,057,490 B2
(45) Date of Patent: Jun. 16, 2015

(54) PORTABLE LIGHT HAVING A MOVABLE HEAD AND A USB CHARGING PORT

(71) Applicant: Streamlight, Inc., Eagleville, PA (US)

(72) Inventors: Raymond L. Sharrah, Collegeville, PA (US); Peter J. Ziegenfuss, Sellersville, PA (US); Brian Orme, Phoenixville, PA (US)

(73) Assignee: Streamlight, Inc., Eagleville, PA (US)

( * ) Notice: Subject to any disclaimer, the term of this patent is extended or adjusted under 35 U.S.C. 154(b) by 0 days.

(21) Appl. No.: 13/969,972

(22) Filed: Aug. 19, 2013

(65) Prior Publication Data

US 2013/0335954 A1 Dec. 19, 2013

Related U.S. Application Data

(60) Division of application No. 13/195,306, filed on Aug. 1, 2011, now Pat. No. 8,511,847, which is a continuation of application No. 29/367,099, filed on Aug. 3, 2010, now Pat. No. Des. 680,672.

(60) Provisional application No. 61/447,279, filed on Feb. 28, 2011.

(51) Int. Cl.
*F21L 4/00* (2006.01)
*F21L 4/04* (2006.01)
(Continued)

(52) U.S. Cl.
CPC ... *F21L 4/04* (2013.01); *F21L 4/08* (2013.01); *F21V 9/083* (2013.01); *F21V 21/08* (2013.01);
(Continued)

(58) Field of Classification Search
CPC ..... F21L 4/04; F21L 4/08; F21V 9/083; F21V 21/08; F21V 21/0808; F21V 21/0832; F21V 21/0885; F21V 29/70; F21Y 2101/02
USPC ..... 362/183, 191, 199–201, 205, 208, 396
See application file for complete search history.

(56) References Cited

U.S. PATENT DOCUMENTS

D139,628 S 12/1944 Chapman
2,539,974 A 1/1951 Riddell
(Continued)

FOREIGN PATENT DOCUMENTS

JP 2007-500933 1/2007
JP 3133833 7/2007
(Continued)

OTHER PUBLICATIONS

Armament Systems and Procedures, "Triad USB—Micro USB Rechargeable LED Light", Press Release, Aug. 16, 2012, 2 pages, http://www.asp-usa.com/press-releases/triad-usb-micro-usb-recharg eable-led-light.html.
(Continued)

*Primary Examiner* — Stephen F Husar
(74) *Attorney, Agent, or Firm* — Clement A. Berard, Esq.; Dann, Dorfman, Herrell & Skillman, PC

(57) ABSTRACT

A rechargeable portable light may comprise: a generally rectangular light body having a cavity therein; a rechargeable source of electrical power disposed in the cavity of the light body; a light source supported by the light body for producing light; a switch for selectively actuating the light source; a USB compatible connector on the light body electrically coupled for charging the rechargeable source of electrical power. The light source may be movable relative to the light body. The light may also include a clip attached to the light body for attaching the light to a person and/or object.

25 Claims, 7 Drawing Sheets

(51) Int. Cl.

| | |
|---|---|
| ***F21L 4/08*** | (2006.01) |
| *F21V 9/08* | (2006.01) |
| *F21V 21/08* | (2006.01) |
| *F21V 21/088* | (2006.01) |
| *F21Y 101/02* | (2006.01) |

(52) U.S. Cl.
CPC ..... *F21V 21/0808* (2013.01); *F21V 21/0832* (2013.01); *F21V 21/0885* (2013.01); *F21Y 2101/02* (2013.01); *F21V 29/70* (2015.01)

(56) References Cited

U.S. PATENT DOCUMENTS

| | | | | |
|---|---|---|---|---|
| 2,612,598 | A | 9/1952 | Berman | |
| 2,949,612 | A | 8/1960 | Kafko et al. | |
| RE31,458 | E | 12/1983 | Trattner | |
| D296,827 | S | 7/1988 | Yuen | |
| D306,212 | S | 2/1990 | Holterscheidt | |
| 5,050,053 | A | 9/1991 | McDermott | |
| D328,144 | S | 7/1992 | Yuen | |
| D332,839 | S | 1/1993 | Beckner, Jr. | |
| D344,358 | S | 2/1994 | Yuen | |
| D349,776 | S | 8/1994 | Yuen | |
| D413,993 | S | 9/1999 | Yuen | |
| 6,022,119 | A | 2/2000 | Booty, Jr. | |
| D425,642 | S | 5/2000 | Zeller | |
| 6,142,644 | A | 11/2000 | Leung | |
| D435,679 | S | 12/2000 | Naghi et al. | |
| 6,469,619 | B1 | 10/2002 | Mayercheck et al. | |
| 6,471,064 | B2 | 10/2002 | Gordon | |
| 6,764,202 | B1 | 7/2004 | Herring et al. | |
| 6,905,223 | B2 | 6/2005 | Halasz | |
| 6,953,260 | B1 | 10/2005 | Allen | |
| D518,584 | S | 4/2006 | Chan | |
| 7,021,783 | B2 | 4/2006 | Quittner | |
| 7,033,036 | B2 | 4/2006 | Pederson | |
| 7,048,403 | B2 | 5/2006 | Parker et al. | |
| D548,384 | S | 8/2007 | Komar et al. | |
| D549,379 | S | 8/2007 | Sharrah et al. | |
| 7,306,348 | B2 | 12/2007 | Quittner | |
| 7,435,508 | B2 | 10/2008 | Lee et al. | |
| 7,466,082 | B1 | 12/2008 | Snyder et al. | |
| D589,186 | S | 3/2009 | Coushaine et al. | |
| 7,497,584 | B1 | 3/2009 | Quittner | |
| 7,513,662 | B2 | 4/2009 | Parker et al. | |
| D595,875 | S | 7/2009 | Irvine | |
| 7,581,847 | B2 | 9/2009 | Dalton | |
| D611,629 | S | 3/2010 | Sharrah et al. | |
| 7,802,909 | B2 * | 9/2010 | Baker | 362/183 |
| D645,179 | S | 9/2011 | Gulker | |
| D647,229 | S | 10/2011 | Ma | |
| 8,066,396 | B2 | 11/2011 | Hunt | |
| D650,933 | S | 12/2011 | Cheng | |
| D655,433 | S | 3/2012 | Levine | |
| D667,404 | S | 9/2012 | Akana et al. | |
| 8,356,910 | B2 | 1/2013 | Messinger et al. | |
| 8,511,847 | B2 | 8/2013 | Sharrah et al. | |
| 2002/0191396 | A1 | 12/2002 | Reiff et al. | |
| 2003/0112624 | A1 | 6/2003 | Quittner | |
| 2005/0041428 | A1 | 2/2005 | Zhang | |
| 2005/0231941 | A1 * | 10/2005 | Huang | 362/200 |
| 2007/0159809 | A1 | 7/2007 | Kim et al. | |
| 2007/0159810 | A1 | 7/2007 | Kim | |
| 2007/0171629 | A1 | 7/2007 | Langenwalter | |
| 2008/0316736 | A1 | 12/2008 | Hunnewell | |
| 2009/0290335 | A1 | 11/2009 | Levine | |
| 2010/0002421 | A1 | 1/2010 | Arnold, III | |
| 2010/0033960 | A1 | 2/2010 | Levine | |
| 2010/0046211 | A1 | 2/2010 | Spartano | |
| 2010/0165609 | A1 | 7/2010 | Sohn | |
| 2010/0165633 | A1 | 7/2010 | Moolman et al. | |
| 2010/0301779 | A1 | 12/2010 | Spartano et al. | |
| 2012/0235593 | A1 | 9/2012 | Sharrah et al. | |

FOREIGN PATENT DOCUMENTS

| | | |
|---|---|---|
| JP | 2008-269974 | 11/2008 |
| WO | WO 2004/111530 | 12/2004 |
| WO | WO 2008/094013 | 8/2008 |

OTHER PUBLICATIONS

Light Reviewers, "NexTorch myTorch (18650) Review", Feb. 2011, 21 pages, http://lightreviewers.com/2011/02/nextorch-18650-review.html.

SureFire, LLC, "Headlamps", http://www.surefire.com/headlamps, ©2010, 3 pages.

Underwater Kinetics, "Vizion eLED—Waterproof LED Headlamp", ©2007, 1 page.

Lab Safety Supply, "Bright Star® WorkSafe® Razor Zone Zero Flashlight", © 2011 GHC Specialty Brands, LLC, www.labsafety.com/bright-star-worksafe-razor-zone-zero-flashlight_24535811, 2 pages.

Global Stores Group Industrial & Safety Division, "Bright Star Razor LED Flashlights", © 2006, www.allsafetysupplies.com/bright-star-razor-LED-flashlights_p_14674, 2 pages.

Bright Star, "Product Data Sheet: Razor 3AA-cell LED Flashlight", date prior to May 5, 2011, 1 pg.

Cat Eye Co., Ltd., "Headlights", http://www.cateye.com/en/product . . . , © 2010, 23 pages.

International Searching Authority/US, "International Search Report—Application No. PCT/US2011/046119", Dec. 12, 2011, 2 pages.

USPTO, "Notice of References Cited (PTO-892) U.S. Appl. No. 29/367,099", mail date Dec. 12, 2012, 1 page.

Amazon.com , "ASP Triad USB LED Flashlight 35625", Printed on or about Sep. 9, 2014, 4 pages, http://www.amazon.com/ASP-Triad-USB-flashlight-35625/dp/B00AQ1RBPK.

Japanese Patent Office, "Notice of Reasons for Refusal—JP Patent Application No. 2013-523244", Oct. 28, 2014, including English Translation, 6 pages.

European Patent Office, "Supplementary European Search Report—EP Patent Application No. 11815134.9", Dec. 1, 2014, 8 pages.

W. Ross McLennan et al., "Rechargeable Clip-On Light With Male USB Connector", U.S. Appl. No. 14/135,803, Filed Dec. 20, 2013, 44 pages.

* cited by examiner

PORTABLE LIGHT HAVING A MOVABLE HEAD AND A USB CHARGING PORT

This Application is a division of U.S. patent application Ser. No. 13/195,306 filed Aug. 1, 2011, soon to be issued as U.S. Pat. No. 8,511,847, which is a continuation of: U.S. patent application Ser. No. 29/367,099 filed Aug. 3, 2010 and of U.S. Provisional Patent Application No. 61/447,279 filed Feb. 28, 2011, each of which is hereby incorporated herein by reference in its entirety, and this Application hereby claims the benefit and priority thereof.

The present invention relates to a portable light and, in particular, to a rechargeable portable light having a USB charging port. The portable light may also include a movable light head or an attachment device, e.g., a clip, or both.

Portable lights, e.g., flashlights, are typically powered by chemical batteries that have a cylindrical shape, such as AA cells, AAA cells, C cells, D cells, CR123 cells, and the like, irrespective of the chemistry of the cell, be it carbon zinc, alkaline, Ni—Cd, NiMH, or Lithium-ion. As a result, flashlights commonly have a cylindrical shape or another shape to accommodate cylindrical batteries.

Some lighting devices employ a rectangular battery, however, many of these rectangular batteries contain cylindrical shaped cells and so may not efficiently employ the volume thereof. The commonly available 9V nine-volt rectangular alkaline cell is one example which contains six cylindrical cells connected in series.

Some batteries are single-use (non-rechargeable), e.g., carbon zinc and alkaline cells, and some are rechargeable, e.g., Ni—Cd, NiMH and Lithium-ion cells. Lights employing rechargeable batteries require external contacts for connecting to a recharging device and so smaller lights tend to not be rechargeable lights.

Some portable lights must be held or placed on a surface, while others may be attached to an object, e.g, by a clip or strap. Some portable lights have light sources that are movable relative to the body of the light so that the beam of light produced may be directed in a desired direction, however, many if not most of these tend to be larger at least in part due to the hinged joints necessary to provide the movable light source. Few lights can combine both small size and rechargeability. Fewer yet are rechargeable lights that can combine small size and directability of the light beam.

Thus, Applicant believes there may be a need for a rechargeable portable light that could be of small size and rechargeable via a standardized connection.

Accordingly, a rechargeable portable light may comprise: a generally rectangular light body having a cavity therein; a rechargeable source of electrical power disposed in the cavity of the light body; a light head including a light source supported by the light body for producing light; a switch for selectively actuating the light source; a USB compatible connector on the light body electrically coupled for charging the rechargeable source of electrical power; and a clip attached to the light body for attaching the rechargeable portable light to a person and/or object.

According to another aspect, a rechargeable portable light may comprise: a generally rectangular light body having a generally rectangular cavity therein; a generally rectangular rechargeable source of electrical power disposed in the cavity of said light body; a light head supported by said light body including a light source for producing light, wherein the light head is movable relative to the light body for directing light in different directions; a switch for selectively actuating the light source; an electronic circuit board disposed between the rechargeable source of electrical power and a wall of said light body including an electronic circuit for controlling operation of the light source responsive to the switch; and a USB port on the light body for connecting to a source of charging power, the USB port connecting to the electronic circuit and to the rechargeable source of electrical power for charging the rechargeable source of electrical power.

According to another aspect, a rechargeable portable light may comprise: a generally rectangular light body having a generally rectangular cavity therein; a rechargeable source of electrical power disposed in the cavity of the light body; a light head supported by the light body including a light source for producing light, wherein the light head is movable relative to the light body for directing light in different directions; a switch for selectively actuating the light source; an electronic circuit for controlling operation of the light source responsive to the switch; and a USB compatible connector on the light body electrically coupled for charging the rechargeable source of electrical power.

According to another aspect, a portable light may comprise: a generally rectangular light body having a pair of extensions thereon, the light body having a cavity for receiving a source of electrical power; a generally cylindrical light head rotatably supported adjacent the light body between the extensions thereof, the light head including a light source for producing light; and a switch for selectively actuating the light source.

According to another aspect, a portable light may comprise: a generally rectangular light body having a pair of spaced apart extensions thereon, the light body having a cavity for receiving a battery; a generally cylindrical light head rotatably supported adjacent the light body between the extensions thereof; a light source in the generally cylindrical light head for producing light; a knob for rotating the generally cylindrical light head; the generally cylindrical light head including at least one lens through which light produced by the light source passes; a switch for selectively actuating the light source to produce light; and a generally rectangular battery in the cavity of the generally rectangular light body for selectively providing electrical power to the light source responsive to the switch.

According to yet another aspect, a portable light may comprise: a generally rectangular light body having a pair of opposing spaced apart projections, the light body having a generally rectangular cavity for receiving a source of electrical power therein; a generally cylindrical light head rotatably supported adjacent the light body between the projections thereof, the light head including a light source for producing light; a switch for selectively actuating the light source; a plurality of electrical conductors providing electrical contacts in the generally rectangular cavity of the light body, wherein the electrical contacts are arranged to receive interchangeably a generally rectangular battery or a plurality of cylindrical batteries; and a source of electrical power in the generally rectangular cavity of the light body including interchangeably a generally rectangular battery having terminals for connecting to the electrical contacts and a plurality of cylindrical batteries having terminals for connecting to the electrical contacts.

BRIEF DESCRIPTION OF THE DRAWING

The detailed description of the preferred embodiment(s) will be more easily and better understood when read in conjunction with the FIGURES of the Drawing which include.

Figure 1:
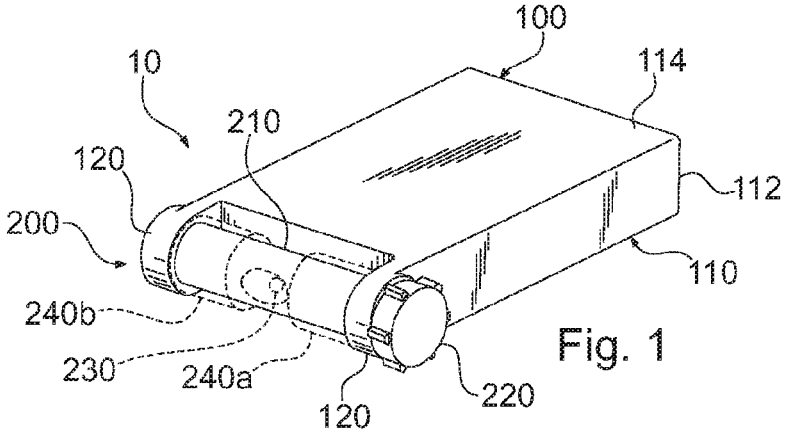
FIG. 1 is a perspective view of an example embodiment of a light.

In the Drawing, where an element or feature is shown in more than one drawing figure, the same alphanumeric designation may be used to designate such element or feature in each figure, and where a closely related or modified element is shown in a figure, the same alphanumerical designation primed or designated "a" or "b" or the like may be used to designate the modified element or feature. Similarly, similar elements or features may be designated by like alphanumeric designations in different figures of the Drawing and with similar nomenclature in the specification. According to common practice, the various features of the drawing are not to scale, and the dimensions of the various features may be arbitrarily expanded or reduced for clarity, and any value stated in any Figure is given by way of example only.

DESCRIPTION OF THE PREFERRED EMBODIMENT(S)

The portable light described herein is in its preferred embodiment a small, rectangular, rechargeable light that provides a directable light beam. It is suitable for being held in use, or for being placed on a surface or attached to an object, e.g., by providing flexible attachment options, as by clips and fasteners. It may have a replaceable battery or may be permanently sealed and disposable. This portable light is thought to be useful and convenient in many different instances, both professional and casual, including but not limited to law enforcement, military, government, industrial, inspection, recreation, sporting, outdoors, and consumer contexts.

Figure 2A:
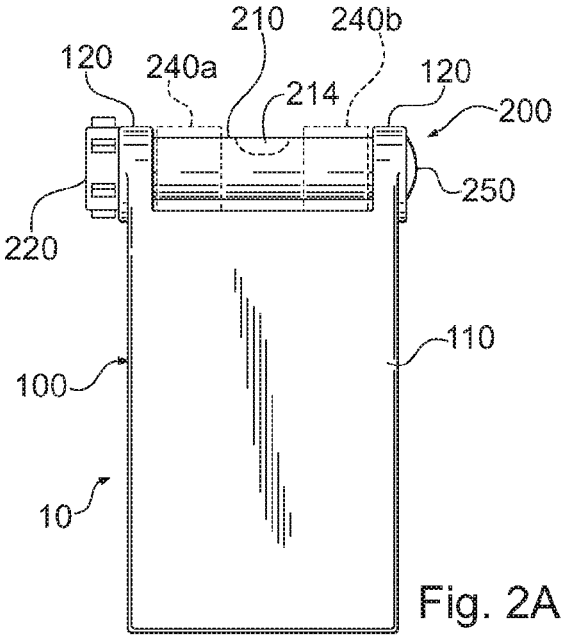
FIGS. 2A, 2B and 2C are views of a side, an edge and an end, respectively.
Figure 2B:
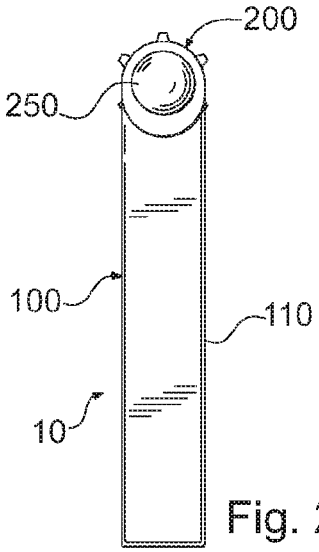
Figure 2C:
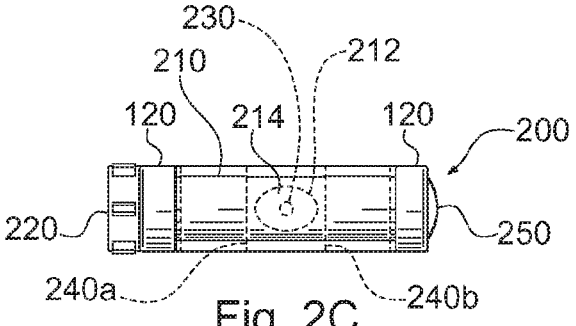
Figure 2D:
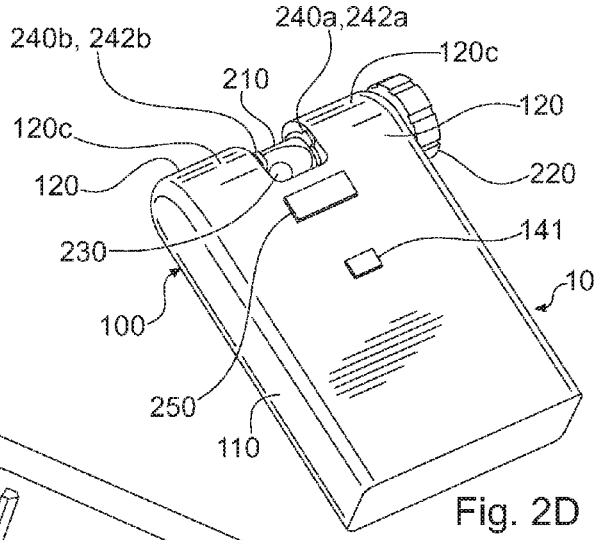
FIG. 2D is a perspective view, of the example light of FIG. 1.

FIG. 1 is a perspective view of an example embodiment of a light 10, and FIGS. 2A, 2B and 2C are views of a side, an edge and an end thereof, respectively, and FIG. 2D is a perspective view thereof. Light 10 includes a generally rectangular light body 100 and a light head 200 thereon, e.g., at an end of light body 100. Light body 100 includes a housing 110 which includes a body housing base 112 and a cover 114 therefor. Interior to light body 100 is a cavity for receiving a battery for providing electrical power to light 10, preferably a battery having a generally rectangular shape, e.g., a battery of the sort utilized with a cell phone or similar portable electronic device, or a battery or batteries that will fit within a generally rectangular battery cavity. Housing 110 has a pair of opposing extensions or projections 120 extending from one end thereof for receiving a generally cylindrical light head 200 therebetween. Preferably, light head 200 is rotatable about its longitudinal axis, e.g., over an angle of about 180° or more or less, and a knob or knobs 220 may be provided for conveniently rotating light head 200.

Light head 200 is generally cylindrical and includes a generally cylindrical member 210 which has a reflector 216, typically a recess 212 of a conical or other suitable shape, therein. A light source 230, preferably a light emitting diode (LED) 230, is located in reflector 216 and is covered by a lens 214 therein. While recess 212 and lens 214 therein are preferably conical, other shapes may be employed as may be desired for shaping the light produced by light source 230. Cylindrical member 210 is preferably of a suitable heat conductive material, e.g., typically aluminum, so as to serve as a heat sink for removing heat produced by light source 230.

Optionally, light head 200 may further include one or more tubular cylindrical lenses 240 or filters 240 that are slidable on cylindrical member 210. Preferably, tubular lenses 240 are substantially shorter than cylindrical member 210 and are at least as long as the diameter of recess 212 at the surface of cylindrical member 210, thereby to be slidable axially to a position for covering lens 214. As a result, the light emitted by light source 230 that passes through lens 214 also passes through a lens 240 when the lens 240 is slid to a position covering lens 214. Preferably, central lens 214 is clear and lens 240 includes two separate slidable tubular lenses 240*a* and 240*b* for providing two optically different lenses. Because tubular lens or lenses 240, 240*a*, 240*b* are on member 210 and because member 210 is retained between extensions 120 of light body 100, lens or lenses 240, 240*a*, 240*b* are captive thereon and so will not be misplaced or lost.

Each slidable tubular lens 240, 240*a*, 240*b* is shorter than cylindrical member 210 and has another optical property than does the other slidable tubular lens 240, 240*a*, 240*b*, e.g., so as to provide selectable lens conditions. For example, lens 240*a* may be a lens of one color, e.g., red, and lens 240*b* may be a lens of a different color, e.g., green, and/or a lens 240*a*, 240*b* could polarize or could diffuse light. A combination of a ridge or another projection on one of cylindrical member 210 and lens or lenses 240*a*, 240*b* and of a depression or recess on the other of member 210 and lens or lenses 240*a*, 240*b*, may engage to retain lens or lenses 240*a*, 240*b* in a centered position over lens 214 or in a storage position proximate an end of member 210.

A switch 250 is provided on light body 100 for controlling operation of light 10. Preferably switch 250 is a pushbutton switch that may be activated one or more times, e.g., in a sequence and/or with a particular timing, for selecting different modes of operation of light 10, such as ON, OFF, momentary ON, blinking, flashing, strobing, brightened and/or dimmed, "moonlight", and/or low light level mode or modes.

Where it is desired that light 10 be rechargeable, e.g., that the battery therein be rechargeable, a charging connector 130 may be provided in housing 110. In a preferred embodiment connector 130 is a small connector or port, e.g., a mini-USB connector, for receiving a cable for connecting to a USB port, e.g., a computer USB port, or other source of electrical power from which the battery can be recharged. Suitable USB connectors and USB cables maybe those commonly employed for connecting a digital camera to the USB port of a computer for transferring image files to the computer. Suitable sources of electrical power for recharging light 10 may include a computer USB port, a 12-volt outlet such as is commonly found in vehicles, or with an adapter such as the type ZTE adapter made by Dokocom of China, a 110v-240 volt AC outlet. Connector 130 may be provided with a cap or plug for providing a seal against moisture and debris, e.g., a threaded cap or plug or a snap-in cap or plug or other seal, may be employed. Such plug or cap may optionally be retained with light 10 by a lanyard or other flexible part.

In light 10 of FIG. 2D, the inward ends of each of the opposing spaced apart extensions or projections 120 include curved covers 120*c* that extend towards the light source LED 230 so as to partly cover lenses 240*a* and 240*b*, thereby to protect lenses 240*a* and 240*b* and for aesthetics. Otherwise, light 10 is as described. The inward ends of lenses 240*a* and 240*b* are exposed beyond the ends of covers 120*c* and each preferably includes an exposed ridge or tab 242*a*, 242*b* that extends radially away from cylindrical light head 200, 210 to facilitate the sliding of lenses 240*a* and 240*b* along cylindrical member 210 for lenses 240*a* and 240*b* being moved into position covering light source 230. Because lenses 240*a* and 240*b* preferably are tubular, or at least include a portion of a tube, and surround cylindrical member 210, they are slidable on cylindrical member 210 and cylindrical member 210 is rotatable within lenses 240*a*, 240*b*. Thus, the rotation of cylindrical member 210, e.g., using knob 220, is not restricted by lenses 240*a* and 240*b* which simply allow member 210 to rotate therein as may be necessary for member 210 to be rotated to a desired rotational position.

A switch 250 may be provided on the on the front surface of housing 110, or at another convenient location, for controlling operation of light source 230. Alternatively, a raised rectangular switch actuator 250 may be located on the front surface of housing 110 for actuating an electrical switch within light body 100' for selectively controlling operation of light source 230. Raised triangular feature 141 may be provided on the front surface of housing 112 as a guide for attaching a band, clip or other fastening device to light 10.

Figure 3:
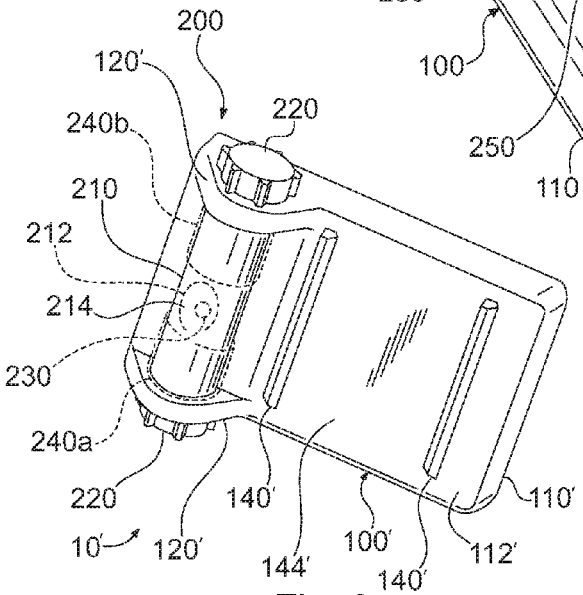
FIG. 3 is a perspective view of another example embodiment of a light.
Figure 4A:
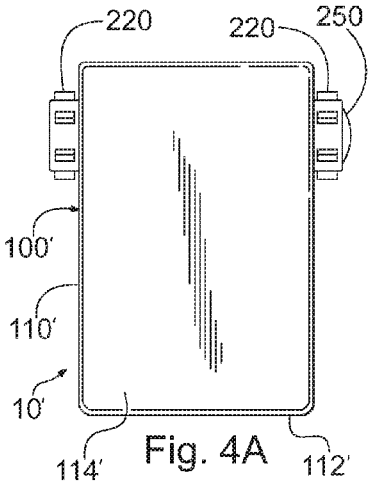
FIGS. 4A, 4B and 4C are views of a bottom side, a top side and an end, respectively.
Figure 4B:
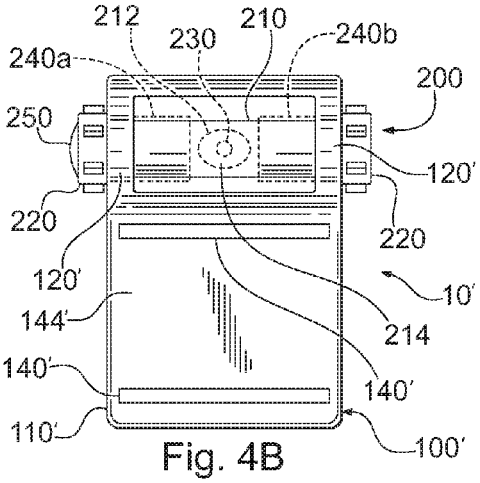
Figure 4C:
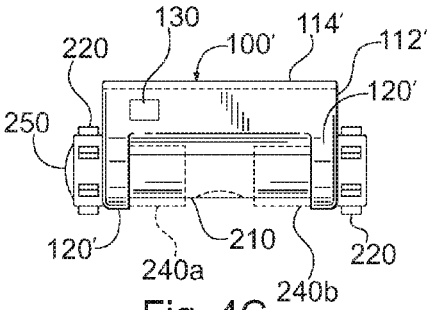
Figure 4D:
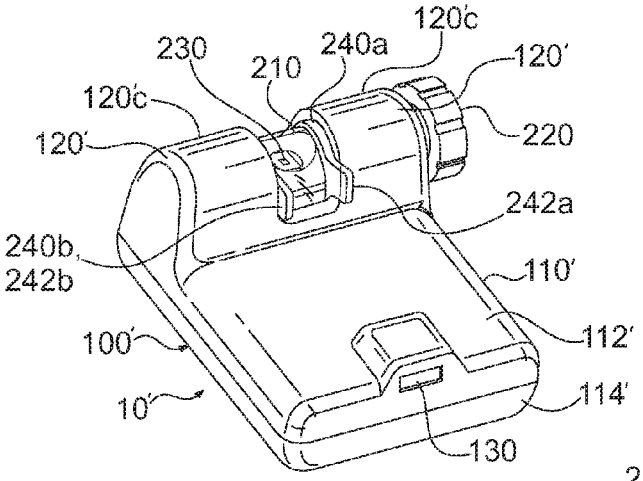
FIG. 4D is a perspective view, of the example light of FIG. 3.

FIG. 3 is a perspective view of another example embodiment of a light 10', and FIGS. 4A, 4B and 4C are views of a bottom side, a top side and an end thereof, respectively, and FIG. 4D is a perspective view thereof. Light 10' includes a light body 100' and a light head 200 thereon, e.g., on a broad surface of light body 100' near one end thereof. Light body 100' includes a generally rectangular housing 110' which includes a body housing base 112' and a cover 114' therefor. Interior to light body 100' is a generally rectangular cavity for receiving a battery for providing electrical power to light 10', preferably a battery having a generally rectangular shape, e.g., a battery of the sort utilized with a cell phone or similar portable electronic device, or another battery or batteries that fit therein. Housing 110' has a pair of opposing extensions or projections 120' extending from one end of a broad surface of light body 100' for receiving a generally cylindrical light head 200 therebetween. Preferably, light head 200 is rotatable about its longitudinal axis and a knob 220, or optionally knobs 220, may be provided for conveniently rotating light head 200.

Light head 200 is generally cylindrical and includes a generally cylindrical member 210 which has a reflector 216, typically a recess 212 of a conical or other suitable shape, therein or a reflective insert 216 therein. A light source 230, preferably a light emitting diode (LED) 230, is located in reflector 216 and is covered by a lens 214 therein in front of LED 230. Light head 200 is as described herein.

Optionally, light head 200 may further include one or more tubular cylindrical lenses 240 or filters 240, 240*a*, 240*b* that are slidable on cylindrical member 210, as described herein. Where it is desired that light 10' be rechargeable, e.g., that the battery therein be rechargeable, a charging connector 130 may be provided in housing 110', with or without an optional cap or plug, all as described herein.

Optionally, light 10' may have one or more features for facilitating the attaching and/or securing of light 10' to an object, e.g., to a person, body part, head wear, clothing, tools, equipment and the like. By way of example, light 10' may have on light body 100' one or more guides 140' for defining a surface 142' or recess 144' into which a band 146*b* or strap 146*b* or clip 146*c* or fastener 146 or other attachment device 146 may be disposed for holding light 10', e.g., to a person's head, hat, helmet or to another object. Guides 140' may be parallel raised ridges 142' as shown or may be another convenient shape. A slip-on or snap-on clip may be provided which has a portion positioned between guides 140' and such clip may be placed on light 10' in several positions, e.g., from the right or left side and/or with the clip at the front or rear of light 10'. Where it is desired to attach light 10' to a hat or helmet, a rubber or other elastic band may be placed around the hat or helmet and light 10' may be placed between the band and the helmet with the band disposed in recess 144' between guides 142'. Where a fastener is used, e.g., a hook and loop fastener such as a VELCRO® material, a piece of either the loop side of the fastener or of the hook side of the fastener is attached, e.g., adhesively, to surface 142' between guides 140'.

In light 10 of FIG. 4D, the inward ends of each of the opposing spaced apart extensions or projections 120' include curved covers 120'*c* that extend towards the light source LED 230 so as to partly cover lenses 240*a* and 240*b*, thereby to protect lenses 240*a* and 240*b* and for aesthetics. Otherwise, light 10' is as described. The inward ends of lenses 240*a* and 240*b* are exposed beyond the ends of covers 120'*c* and each preferably includes an exposed ridge or tab 242*a*, 242*b* that extends radially away from cylindrical light head 200, 210 to facilitate the sliding of lenses 240*a* and 240*b* along cylindrical member 210 for lenses 240*a* and 240*b* being moved into position covering light source 230. Because lenses 240*a* and 240*b* preferably are tubular, or at least include a portion of a tube, and surround cylindrical member 210, they are slidable on cylindrical member 210 and cylindrical member 210 is rotatable within lenses 240*a*, 240*b*. Thus, the rotation of cylindrical member 210, e.g., using knob 220, is not restricted by lenses 240*a* and 240*b* which simply allow member 210 to rotate therein as may be necessary for member 210 to be rotated to a desired rotational position.

Figure 5:
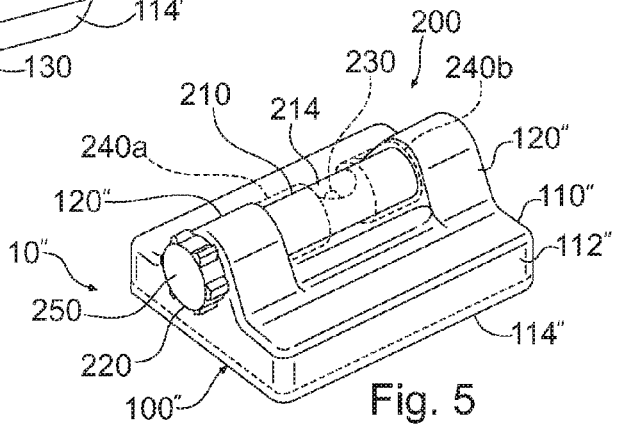
FIG. 5 is a perspective view of yet another example embodiment of a light.
Figure 6A:
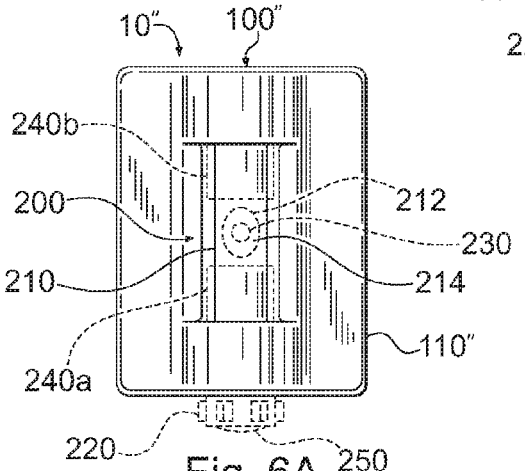
FIGS. 6A, 6B and 6C are views of a top side, a bottom side and an end, respectively, of the example light of FIG. 5.
Figure 6B:
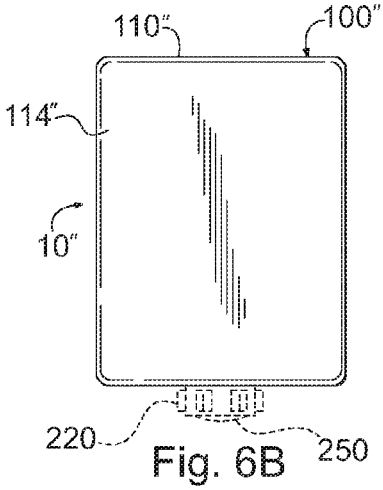
Figure 6C:
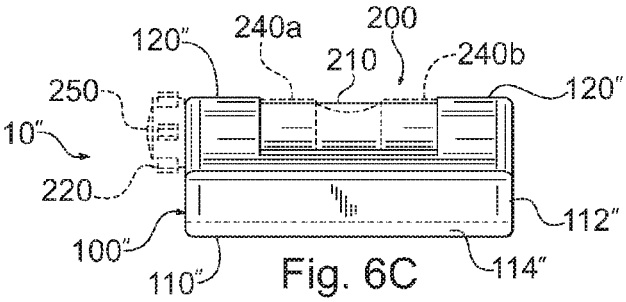

FIG. 5 is a perspective view of yet another example embodiment of a light 10", and FIGS. 6A, 6B and 6C are views of a top side, a bottom side and an end thereof, respectively. Light 10" includes a light body 100" and a light head 200 thereon, e.g., on a broad surface of light body 100" near one end thereof. Light body 100" includes a generally rectangular housing 110" which includes a body housing base 112" and a cover 114" therefor. Interior to light body 100" is a generally rectangular cavity for receiving a battery for providing electrical power to light 10", preferably a battery having a generally rectangular shape, e.g., a battery of the sort utilized with a cell phone or similar portable electronic device, or another battery or batteries that fit therein. Housing 110" has a pair of opposing extensions or projections 120" extending from one end of a broad surface of light body 100" for receiving a generally cylindrical light head 200 therebetween. Preferably, light head 200 is rotatable about its longitudinal axis and a knob 220 or knobs 220 may be provided for conveniently rotating light head 200.

Light head 200 is generally cylindrical and includes a generally cylindrical member 210 which has a reflector 216, typically a recess 212 of a conical or other suitable shape, therein, or a reflector 216 in recess 212. A light source 230, preferably a light emitting diode (LED) 230, is located in reflector 216 and is covered by a lens 214 therein which is in front of LED 230. Light head 200 is as described herein.

Optionally, light head 200 may further include one or more tubular cylindrical lenses 240 or filters 240, 240*a*, 240*b* that are slidable on cylindrical member 210, as described herein. Where it is desired that light 10" be rechargeable, e.g., that the battery therein be rechargeable, a charging connector 130 may be provided in housing 110", with or without an optional cap or plug, all as described herein.

Figure 7:
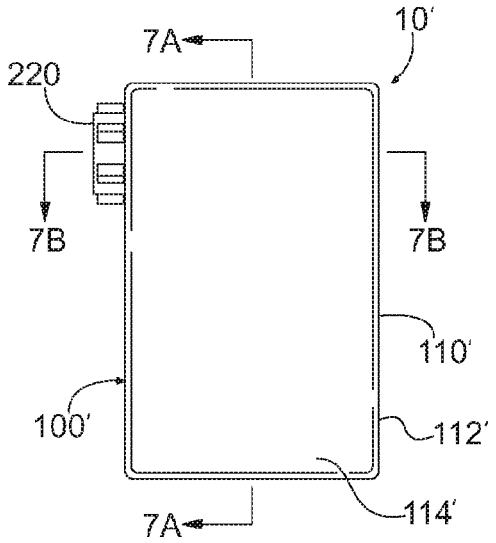
FIG. 7 is a view of a bottom side of the example light and FIGS. 7A and 7B are cross-sectional views transverse to the light head thereof and longitudinal to the light head thereof, respectively.
Figure 7A:
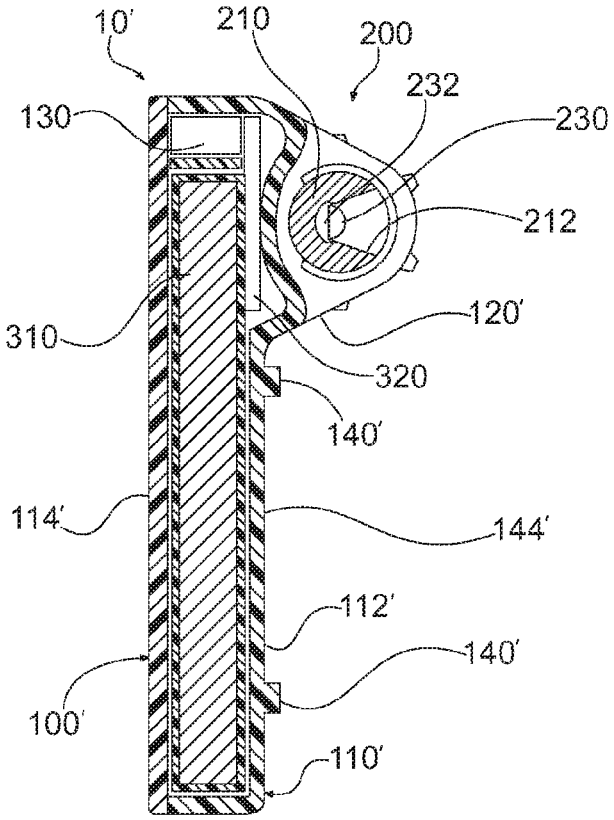
Figure 7B:
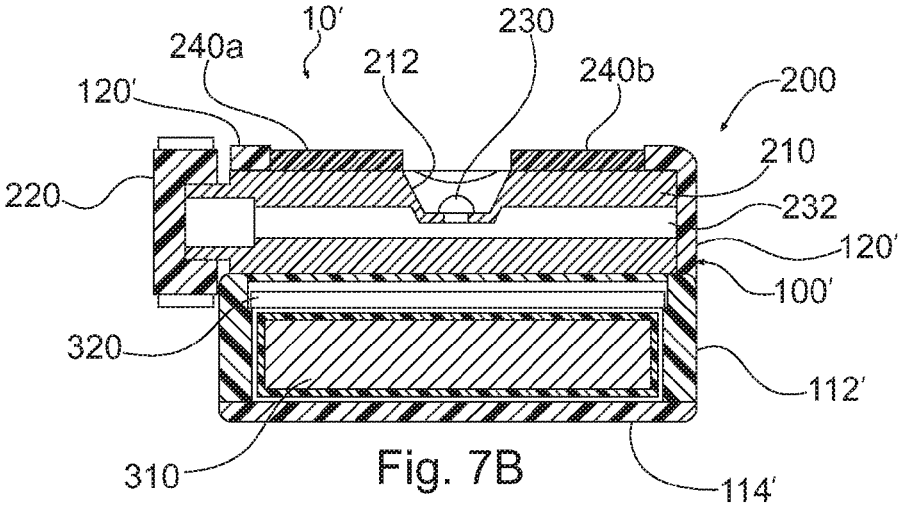
Figure 7C:
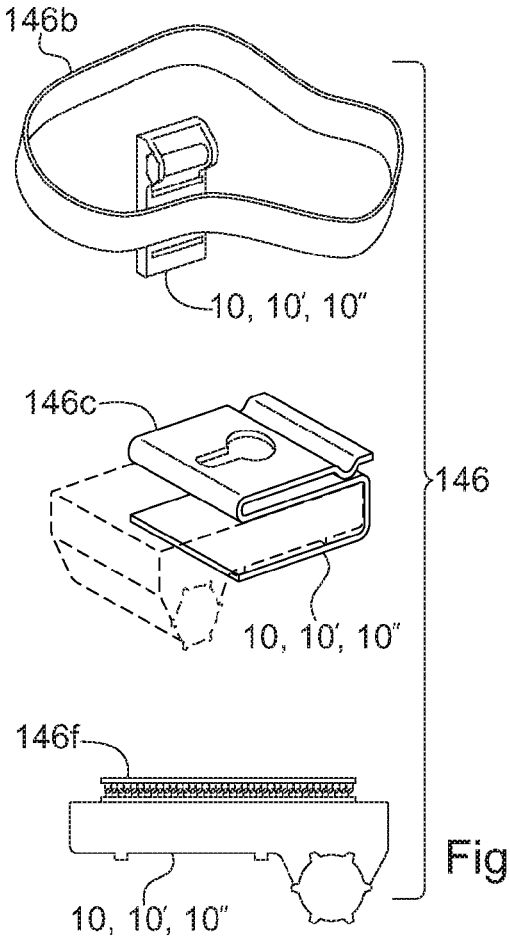
FIG. 7C illustrates various attachment devices.

FIG. 7 is a view of a bottom side of the example light 10' and FIGS. 7A and 7B are cross-sectional views transverse to the light head 200 thereof and longitudinal to the light head 200 thereof, respectively, and FIG. 7C illustrates various attachment devices 146. Interior to housing 110' is an electronic circuit 300 for operating light 10, 10', 10". Circuit 300 includes a battery 310 and an electronic circuit board 320 containing electronic circuitry for connecting battery 310 and light source 230 for controllably energizing light source 230 in response to operation of switch 250. Battery 310 may be of a generally rectangular shape and resides in a generally rectangular cavity in light housing 110, 110', 110" defined by walls of base 112, 112', 112" thereof. The terminals of battery 310 reside at the end thereof proximate light head 200 and make electrical connection to contacts of circuit board 320, typically springy metal contacts that extend from circuit board 320. USB port connector 130 is disposed in the same end of housing 110, 110', 110" where it connects to circuit board 320.

As can be seen of light head 200 in the cross-sectional views, a metal generally cylindrical member 210 has a recess 212 in one cylindrical surface thereof defining a reflector 216 at the bottom end of which is light source 320, e.g., LED 320. LED 320 is preferably disposed on a circuit board 232 which resides at a flat bottom of recess 212. LED circuit board 232 is preferably thermally conductive so as to provide a thermally conductive coupling to cylindrical member 210 which serves as a heat sink for LED 230. A lens 214 may be disposed in the recess 212 defining reflector 216 in front of, and typically covering, light source 230. Reflector 216 and/or lens 214 may be shaped so as to provide a light beam of a desired characteristic or shape, e.g., a spot beam or a flood light beam or something in between.

Cylindrical member 210 preferably has a longitudinal bore therein for electrical wires and/or conductors. Electrical connection between circuit board 320 and light source 230 may be made via electrical wires and conductors, and may include one or more slip rings, coaxial rotatable conductors and the like. Where the electrical connection is made, e.g., by wires, light head 200 may be rotatable over less than 360° relative to light body 100, e.g., about 180°, and where the electrical connection is made, e.g., by slip rings or coaxial rotatable conductors, light head 200 may be rotatable more than 360° relative to light body 100. Electrical connection between switch 250 and circuit board 320 may be made via electrical wires and conductors, and may include one or more slip rings, coaxial rotatable conductors and the like. In one embodiment, one or more springy metal contacts bear against one or more respective circular contacts on cylindrical member 210 to define one or more slip rings, and the sliding of the springy contact against the contact ring tends to clean the connection.

Cylindrical member 210 is rotatably mounted in body extensions or projections 120, 120', 120" which in effect provide bearings, e.g., sleeve bearings, at opposing ends of member 210. Member 210 may be rotated by turning a knob 220 which may be provided at one or both ends of member 210, for directing the light produced by light source 230 over a range of angles of about 180° relative to light body 100, 100', 100". Cylindrical member 210 may be permitted to freely rotate in the bearings of extensions or projections 120, 120', 120" or may be restrained by friction, by detents, by stops or by another restraining feature. Knob 220 may have a recess in the rear surface thereof that presses onto a complementary axial extension of cylindrical member 210, and may be secured thereon by friction, complementary raised and recessed features, adhesive, or other suitable means.

FIG. 7C illustrates various attachment devices 146 that attach to light body 100, 100', 100" of light 10, 10', 10" for attaching light 10, 10', 10" to a person, clothing or an object. Example strap or band 146*b* typically comprises a loop of elastic material, e.g., of a rubber or stretchy plastic, sized to encircle an object to which light 10, 10', 10" is to be attached, e.g., a hat, helmet and/or head, or a loop of relatively non-elastic material, e.g., a woven strip, having a buckle or other length adjustment device for adjusting the length of a loop formed thereby to be sized to encircle an object to which light 10, 10', 10" is to be attached, e.g., a hat, helmet and/or head.

Example clip 146*c* typically comprises a folded structure of a relatively stiff material, e.g., a steel or other metal, wherein one folded portion is sized and spaced apart to clip onto light body 100, 100', 100" bearing against its top and bottom broad surfaces, and another folded portion is sized and relatively closely spaced to clip onto a belt, clothing or other object. The latter portion may have a keyhole or other shaped opening therein for attaching to a headed post or other attaching structure. An example of such structure is described in U.S. Pat. No. 7,581,847 issued Sep. 1, 2009, entitled "CLIP-ON, CLIP OFF MOUNTING DEVICE, AS FOR A PORTABLE LIGHT," which is hereby incorporated herein by reference in its entirety.

Example fastener 146 includes a separable fastener 146*f*, such as a hook and loop or similar fastener 146*f*, e.g., a VELCRO® fastener, one side of which may be attached, e.g., by adhesive, to light body 100, 100', 100" and the other side of which may be attached, e.g., by adhesive , sewing or other suitable means, to a person or object to which light 10, 10', 10" is to be removably attached.

Figure 8:
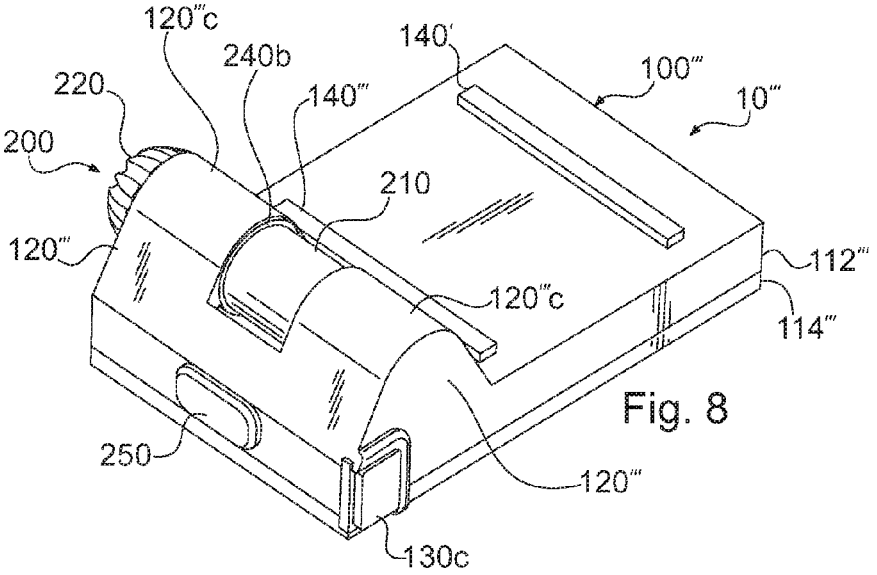
FIG. 8 is a perspective view of an example embodiment of a light similar to the example light of FIG. 3.

FIG. 8 is a perspective view of an example embodiment of a light 10''' similar to the example light 10' of FIG. 3. Light 10''' includes a generally rectangular light body 100'''' and a light head 200 including a cylindrical member 210 supported at its ends by extensions or projections 120''' of body housing 110''' which comprises housing base 112''' from which extensions or projections 120''' extend and housing cover 114'''. Light head 200 is as described.

Light head 200 may include slidable lenses or filters 240*a*, 240*b* as above, however, in light 10''' lenses or filters 240*a* and/or 240*b* may be covered by an optional cover 120'''*c* that attaches to the outer ends of extensions or projections 120'''. Light body 100''' may have ridges 140''' or similar features for locating a band 146*b* or clip 146*c* or other member or attachment device 146 for attaching light 10''' to a person or object.

Light 10''' includes a switch actuator 250, e.g., a flexible member, on an end of body 100''' that when pressed actuates an electrical switch internal to body 100'''. Switch actuator 250 may be of a rubber, plastic or other material that allows actuator 250 to flex for transmitting pressing force applied to it to the internal electrical switch. USB connector 130 at the near corner preferably has a cover 130*c* for resisting the entry of moisture, water, dirt and other unwanted matter into housing 110''' and may be held captive by a thin loop or lanyard so that it is tethered to light body 100'''. Cover 130*c* may be of a rubber, plastic or other material that provides the desired flexibility and sealing of the opening to connector 130.

Figure 8A:
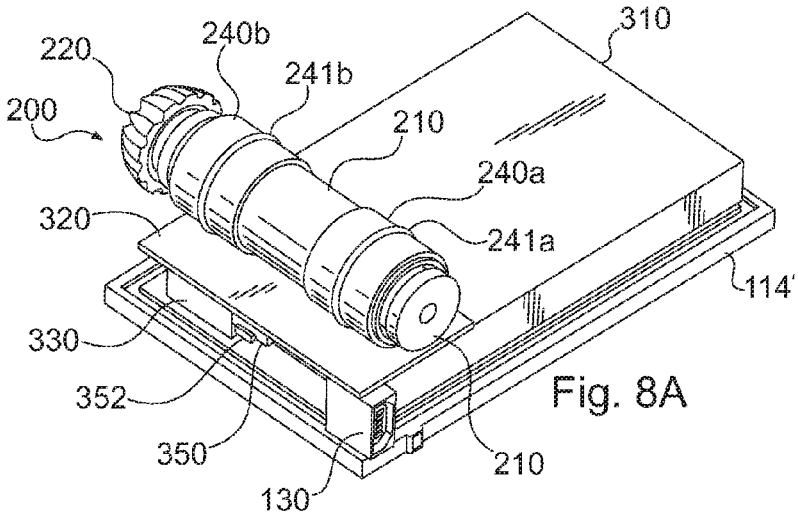
FIG. 8A is a perspective view of the example light of FIG. 8 with the housing base removed.
Figure 8B:
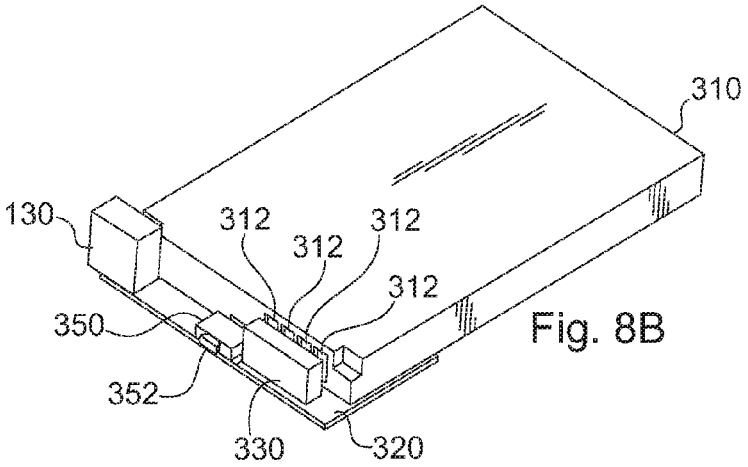
FIG. 8B is an inverted perspective view of the example light of FIGS. 8 and 8A with the housing base, housing cover and light head removed.

FIG. 8A is a perspective view of the example light 10' of FIG. 8 with the housing base 112' removed; and FIG. 8B is an inverted perspective view thereof with the housing base 112', housing cover 114' and light head 200 removed, thereby to reveal the internal arrangement of light 10'. Light head 200 is seen to include a cylindrical member 210 having a recess therein in which is disposed a light source 230, e.g., an LED 230, for which member 210 provides a heat sink A knob 220 on one end of cylindrical member 210 provides a convenient feature for rotating cylindrical member 210 about its longitudinal axis. One or two optional tubular lenses or filters 240*a*, 240*b* are slidable on cylindrical member 210 and may be slid to a central location along member 210 so that the light produced by light source 230 passes therethrough. Optionally, lenses/filters 240*a*, 240*b* may have ridges or other features 241*a*, 241*b* thereon for facilitating the sliding of lenses/filters 240*a*, 240*b*, respectively.

The largest element internal to light body 100''' is battery 310 which may be a rectangularly shaped cell 310, e.g., a cell of the sort commonly utilized by cellular telephones, smart phones and similar small handheld electronic devices, that is retained in housing base 112''' by cover 114'''. Battery 310 typically has two or more terminals 312 on a narrow end thereof for delivering electrical power, and for receiving electrical power if battery 310 is a rechargeable battery.

Battery 310 resides between housing cover 114''' and electronic circuit board 320 which supports the electronic circuitry that controls light 10'''. A connector 330 mounted on circuit board 320 may be employed for connecting to the terminals of battery 310 for receiving electrical power therefrom and for applying electrical power thereto for charging battery 310. A connector 130, e.g., a USB or mini-USB connector 130, mounted on circuit board 320 may be employed for receiving electrical power from an external source for charging battery 310.

An electrical switch 350 mounted on circuit board 320 may have an actuator 352 on an outward facing side thereof so as to be positioned behind (underneath) switch actuator 250 of light body 100''', whereby pressing on switch actuator 250 causes switch actuator 250 to press against actuator 352 of electrical switch 350 for causing switch 350 to control light source 230 via control circuitry on circuit board 320. The switch actuator 250 may be a flexible cover or boot, e.g., of a rubber, rubbery or flexible plastic material, that is co-molded with a part of housing 110''', e.g., housing base 110''' or housing cover 110''', or may be a cover or boot that is fastened in a hole therein. In general, switch actuator 250 may be in any convenient location of the light body 100, 100', 100'', 100''', and more than one switch actuator 250 may be provided with an electrical switch 350 appropriately located interior thereto.

Electronic circuit 300 may be any electronic circuit that provides the desired functionality of light 10, 10', 10'', 10'''. Examples of suitable electronic circuits that may be employed may be found, for example, in U.S. Pat. No. 7,883,243 entitled "LED FLASHLIGHT AND HEAT SINK ARRANGEMENT," in U.S. Pat. No. 7,674,003 entitled "FLASHLIGHT HAVING PLURAL SWITCHES AND A CONTROLLER," in U.S. Pat. No. 7,466,082 entitled "ELECTRONIC CIRCUIT REDUCING AND BOOSTING VOLTAGE FOR CONTROLLING LED CURRENT," and/or in U.S. patent application Ser. No. 13/050,498 entitled "LIGHT HAVING A COMPARTMENT ACCOMMODATING BATTERIES OF DIFFERENT SIZES, SHAPES AND/OR TYPES," filed Mar. 17, 2011, now U.S. Patent Publication No. 2012/0236551, each of which is hereby incorporated herein by reference in its entirety for any and all purposes.

Figure 9:
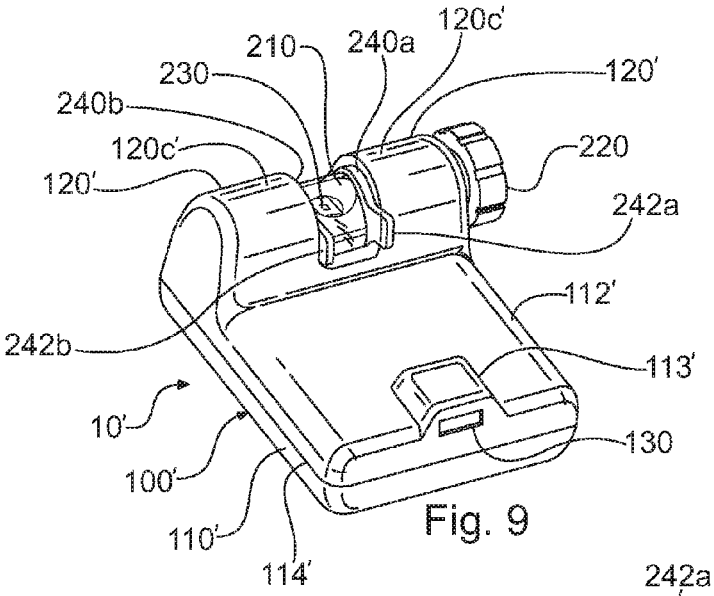
FIG. 9 is a perspective view of an example light similar to the example light of FIG. 4.
Figure 9A:
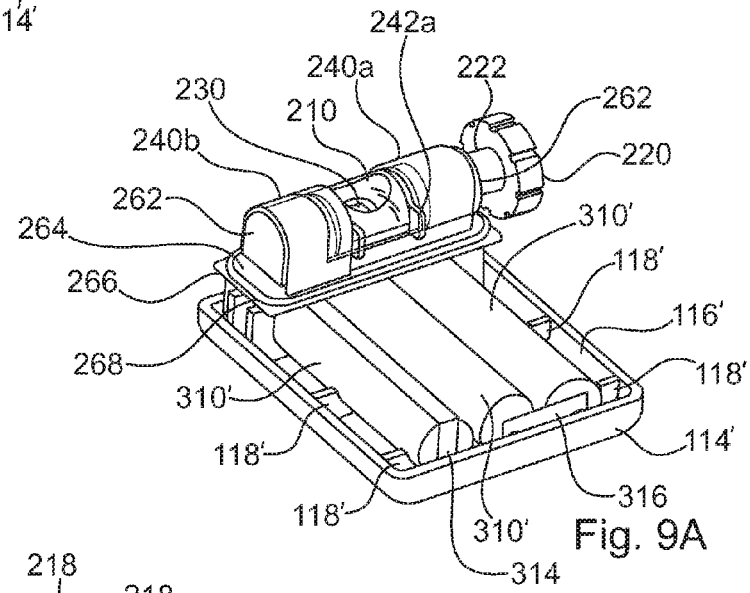
FIG. 9A is a perspective view thereof with the housing removed.
Figure 9B:
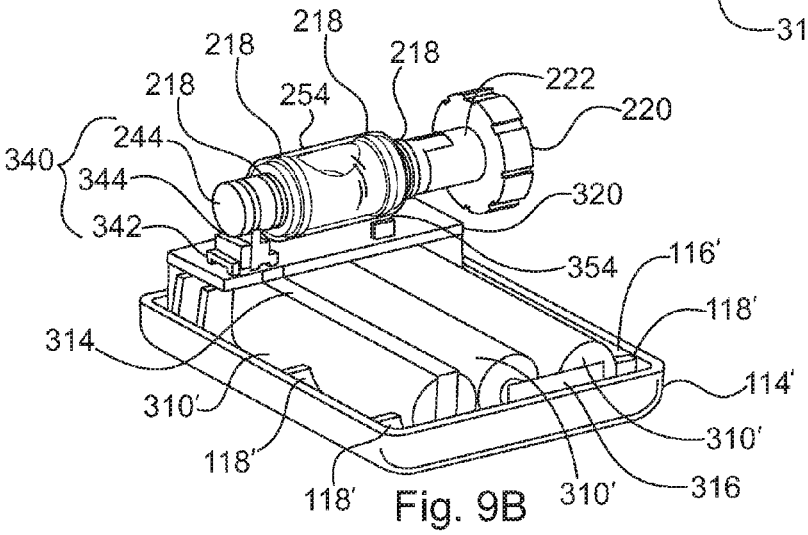
FIG. 9B is a perspective view thereof with the housing and lens elements removed.

FIG. 9 is a perspective view of an example light 10' similar to the example light 10' of FIG. 4, FIG. 9A is a perspective view thereof with the housing part 112' removed, and FIG. 9B is a perspective view thereof with the housing part 112' and lens 240 elements removed. Externally, light 10' differs from the light of FIG. 4 in that the inward ends of each of the opposing spaced apart extensions or projections 120' include curved covers 120'*c* that extend towards the light source LED 230 so as to partly cover lenses 240*a* and 240*b*, e.g., thereby to protect lenses 240*a* and 240*b* and for aesthetics. Otherwise, light 10' is as described. The inward ends of lenses 240*a* and 240*b* are exposed beyond the ends of covers 120'*c* and each preferably includes a respective exposed ridge or tab 242*a*, 242*b* that extends radially away from cylindrical light head 200, 210 to facilitate the sliding of lenses 240*a* and 240*b* along cylindrical member 210 for lenses 240*a* and 240*b* being moved into position covering light source 230. Because lenses 240*a* and 240*b* preferably are tubular, or at least include a portion of a tube, and surround cylindrical member 210, they are slidable on cylindrical member 210 and cylindrical member 210 is rotatable within lenses 240*a*, 240*b*. Thus, the rotation of cylindrical member 210, e.g., using knob 220, is not restricted by lenses 240*a* and 240*b* which simply allow member 210 to rotate therein as may be necessary for member 210 to be rotated to a desired rotational position.

Where light 10' may utilize a source of electrical power that is rechargeable, light body 100' may have a raised portion 113', e.g., on housing portion 112' or at another suitable location, for enclosing a battery charging connector 130, e.g., a mini USB connector or other suitable electrical connector. Connector 130 connects externally to a source of electrical power for charging a battery 310, 310' internal to light body 100' and connects internally to electronic circuit 300 for charging a rechargeable battery 310, 310' in light body 100' and/or for powering light 10' when light 10' is connected to an external source of electrical power via connector 130.

Interior to light body 100' of light 10' is support member 260 which includes a generally rectangular base 264 having semi-cylindrical receptacles 262 at opposing ends thereof. Receptacles 262 have an external shape generally conforming with the shape of lenses 240*a*, 240*b* which are slidable thereon and have an interior shape that provides at least a part of a cylindrical surface adjacent which the cylindrical ends of cylindrical member 210 may rotate. The support receptacle 262 at the end of cylindrical member 210 whereat knob 220 is located typically has an opening through the generally circular end thereof through which the shaft 222 of knob 220 is disposed to engage the end of cylindrical member 220. Support 260 preferably positions cylindrical member 210 and optional lenses 240*a*, 240*b* in desired positions in extensions or projections 120' and in light housing part 112' when light housing part 112' is mated with light housing part 114' to define light body housing 110'.

The base 264 of support member 260 is disposed adjacent circuit board 320 and may be of similar shape and size thereto. Circuit board 320 may support a support block 342 which includes one or more metal contacts 344 that respectively contact one or more circular contact rings 244 of cylindrical member 210, which together define one or more slip rings 340 providing one or more electrical connections across the rotatable joint between cylindrical member 210 and circuit board 320 and the remainder of electrical circuit 300 of light 10'. Circuit board 320 may also support one or more additional metal contacts 354 that bear against respective contact rings 254 of cylindrical member 210 to define one or more additional slip rings 350 providing respective electrical connections across the rotatable joint between cylindrical member 210 and circuit board 320 and the remainder of electrical circuit 300 of light 10'.

Light body 100' housing 110' includes housing parts 112', 114' that define an generally rectangular interior cavity 116' for receiving a source of electrical power 310. The source of electrical power may include, e.g., a generally rectangular battery 310 as described or may include, e.g., one or more cylindrical batteries 310' as a particular light 10, 10', 10", 10"' may utilize, or may accept both batteries of both shapes and sizes. Housing part 114' and/or housing part 112' may have one or more locating features 118' that extend into cavity 116' for positioning battery 310 and/or batteries 310' therein. Locating features 118' may have, e.g., a curved edge against which batteries 310' are adjacent for being positioned in cavity 116' and may have other edges for positioning a generally rectangular battery 310, or may have both where cavity 116' is configured to receiver both a generally rectangular battery 310 and plural cylindrical batteries 310'. Where cylindrical batteries 310' are utilized, conductors 314, 316, e.g., metal conductive strips 314, 316, may be provided to connect batteries 310' in series and into circuit 300, and conductors 314, 316 may be part of light body 110' or may be part of a battery assembly 310' wherein plural cylindrical batteries are connected in series within battery assembly 310'.

Light body 100' may include various features of any one or more of lights 10, 10", 10"' as described, e.g., a switch or switch actuator 250, a charging connector 130, guides 140', and the like, as may be convenient or desirable for a particular light. Optionally, cylindrical member 210 may have one or more grooves in which reside respective O-rings 218 for providing a seal with respect to support member 260, and support member 260 may include an O-ring 268 around the periphery of base 264 thereof for providing a seal with respect to housing part 112'.

In one typical example embodiment of a light 10, 10', 10", 10"', light body 100, 100', 100", 100"' is about 1.6 by 2.5 inches (about 4.1 by 6.4 cm) and about 0.38 inch (about 1 cm) thick, and optional guides 140 thereon are about 1.0 inch (about 2.5 cm) apart. Cylindrical member 210 thereof may have a diameter of about 0.5 inch (about 1.3 cm) and an exposed length of about 1.25 inches (about 3.2 cm), and the cone angle of recess 212 or of reflector 216 may be about 90°, but may be a larger or smaller angle. Slidable lenses 240, 240*a*, 240*b* have respective lengths of about 0.4 inches (about 1.0 cm), and may have an optional external circumferential ridge for assisting their being slid along member 210. The axis of rotatable member 210 is about 0.28 inches (about 7 mm) above the surface of housing 100, 100', 100", 100"' so that rotatable member 210 and optional lens or lenses 240, 240*a*, 240*b* are adjacent to light body 100, 100', 100", 100"', e.g., are spaced away by about 0.20-0.50 inch (about 0.5-1.3 mm). Where light 10, 10', 10", 10"' utilizes cylindrical batteries, e.g., AAA size or AA size nickel-metal hydride (Ni-MH) batteries 310', light body 100, 100', 100", 100"' may be slightly thicker and/or larger to accommodate the diameter and/or length of those batteries, however, the cavity 116 within such light body 100, 100', 100", 100"' may be configured to receive a rectangular battery 310 interchangeably with plural cylindrical batteries 310' or an assembly thereof.

In a typical embodiment of light 10, 10', 10", 10"', light housing 110, 110', 110", 100"' including housing base 112, 112', 112", 112"' and cover 114, 114', 114", 114"' may be a plastic, e.g. a nylon, ABS, polycarbonate (PC), or a blend thereof, e.g., a PC/ABS blend, and lens 240, 240*a*, 240*b* may be polycarbonate, PMMA acrylic, or other suitable plastic or glass, and member 210 may be aluminum, brass, copper, or other suitable thermally conductive material. Member 210 may have a recess 212, e.g., a conical recess 212, typically having a cone angle of about 90° with a flat bottom for receiving LED circuit board 232 and LED 230, or a reflector 216 shaped to provide a desired beam shape may be disposed in the recess 212 or may be defined by recess 212 of cylindrical member 210. Housing 110, 110', 110", 110"' may be closed by attaching cover 114, 114', 114", 114"' permanently to housing 112, 112', 112", 112"', as by ultrasonic, chemical or heat welding or by adhesive, or by attaching cover 114, 114', 114", 114"' removably to housing 112, 112', 112", 112"' as by a snap on engagement or by removable fasteners or the like.

Typically, battery 310, 310' could be a rechargeable battery such as a prismatic rectangular lithium-ion battery which is available from many commercial sources or could be one or more cylindrical batteries such as an alkaline, lithium or other single use battery or a nickel-cadmium, nickel-metal-hydride or lithium-ion or other rechargeable battery which are available from many commercial sources, as well as various manufacturers and suppliers of cellular telephones, smart phones, MP3 players, and other mobile electronic devices, and/or from suppliers of batteries therefor. Electronic circuit 300 may be as described, switch 250, 350 may be an ON/OFF switch, e.g., a momentary contacting switch or a "clicker" type latching ON/OFF switch, and may have a momentary ON position, and circuit board 310 may be of FR4 or other suitable material. Connector 130 may be a USB or a mini-USB connector of the sort commonly utilized in cellular telephones, smart phones, MP3 players, digital cameras and other mobile electronic devices, and connector 330 may be a battery connector of the sort commonly utilized in cellular telephones, smart phones, MP3 players, digital cameras and other mobile electronic devices.

A portable light 10, 10', 10", 10"' may comprise: a generally rectangular light body 100, 100', 100", 100"' having a pair of opposing spaced apart extensions 120, 120', 120", 120"' thereon, the light body 100, 100', 100", 100"' having a generally rectangular cavity for receiving a source of electrical power 310 therein; a generally cylindrical light head 200 rotatably supported adjacent the light body 100, 100', 100", 100"' between the extensions 120, 120', 120", 120"' thereof, the light head 200 including a light source 230 for producing light; and a switch 250 for selectively actuating the light source 230. The generally cylindrical light head 200 may be located: adjacent an end of the light body 100, 100', 100", 100"'; or adjacent a broad surface of the light body 100, 100', 100", 100"'; or adjacent a broad surface of the light body 100, 100', 100", 100"' near an end of the light body 100, 100', 100", 100"'. In the portable light 10, 10', 10", 10"', the generally cylindrical light head 200 may be rotatable about its axis; or the generally cylindrical light head 200 may include a knob 220 at an end thereof for rotating the generally cylindrical light head 200 about its axis; or the generally cylindrical light head 200 may be rotatable about its axis and may include a knob 220 at an end thereof for rotating the generally cylindrical light head 200 about its axis. The cylindrical light head may be rotatable less than 360° or may be rotatable more than 360°. The generally cylindrical light head 200 may include at least one circular electrical contact 244 and the light body 100, 100', 100", 100"' may include at least one fixed electrical contact 344 adjacent the circular electrical contact 244 of the generally cylindrical light head 200 for providing at least one electrical slip ring 340 connection therebetween. The generally cylindrical light head 200 may include a cylindrical member 210 and a curved lens 240, 240*a*, 240*b* slidable along the cylindrical member 210. The curved lens 240, 240*a*, 240*b* may include one or more slidable curved lenses 240, 240*a*, 240*b*, each slidable curved lens 240, 240*a*, 240*b* being shorter than the cylindrical member 210 and having a different optical property than another slidable curved lens 240, 240*a*, 240*b*. The curved lens 240, 240*a*, 240*b* may be captive adjacent the cylindrical member 210; or may include one or more color filters, a polarizing filter, and/or a diffusing filter; or may include one or more color filters, a polarizing filter, and/or a diffusing filter and be captive adjacent the cylindrical member 210. The generally cylindrical light head 200 may include a cylindrical member 210 having a recess 212 therein and the light source 230 may include a light emitting diode 230 in the recess 212 of the cylindrical member 210. The portable light 10, 10', 10", 10''' may further comprise a lens 214 in the recess 212 of the cylindrical member 210 covering the light emitting diode 230. The portable light 10, 10', 10", 10''' may further comprise: a reflector 216 in the recess 212 of the cylindrical member 210 in front of the light emitting diode 230; or a lens 214 in the recess 212 of the cylindrical member 210 in front of the light emitting diode 230; or a reflector 216 and a lens 214 in the recess 212 of the cylindrical member 210 in front of the light emitting diode 230. The generally cylindrical light head 200 may include a cylindrical member 210 comprising a thermally conductive metal or a thermally conductive non-metal. The switch 250 may be actuated: at an end of the generally cylindrical light head 200; or at a knob 220 at an end of the generally cylindrical light head 200; or at an end of the generally cylindrical light head 200 having a knob 220 thereat; or at an end of the generally cylindrical light head 200 opposite an end thereof having a knob 220; or on the generally rectangular light body 100, 100', 100", 100'''; or on an edge of the generally rectangular light body 100, 100', 100", 100'''; or any two of the foregoing. The switch 250, 350 may include an electrical switch 350 disposed on an electronic circuit board 320 in the light body 100, 100', 100", 100''' and actuatable by a switch actuator 250 on the light body 100, 100', 100", 100'. The source of electrical power 310, 310' may include: a generally rectangular source of electrical power 310 in the generally rectangular cavity 116 of the generally rectangular light body 100, 100', 100", 100'''; or a source of electrical power including plural cylindrical sources of electrical power 310' side by side in the generally rectangular cavity 116, 116' of the generally rectangular light body 100, 100', 100", 100'''; or a generally rectangular source of electrical power 310 and plural cylindrical sources of electrical power 310' interchangeable in the generally rectangular cavity 116, 116' of the generally rectangular light body 100, 100', 100", 100'''. In the portable light 10, 10', 10", 10''', a battery 310 may be a rechargeable rectangular battery 310 in the cavity of the light body 100, 100', 100", 100''', and the portable light 10, 10', 10", 10''' may further include: a charging connector 130 on the light body 100, 100', 100", 100''' electrically coupled to a battery 310 therein for charging the battery 310 therein; or a USB compatible charging connector 130 on the light body 100, 100', 100", 100''' electrically coupled to a battery 310 therein for charging the battery 310 therein. The portable light 10, 10', 10", 10''' may further comprise an electronic circuit board 320 including an electronic circuit for controlling operation of the light source 230 responsive to the switch 250. The electronic circuit board 320 may include: a connector 330 for making electrical connection to a source of electrical power 310 when a source of electrical power 310 is in the light body 100, 100', 100", 100'''; or a connector 130 for making electrical connection to an external electrical power source for charging the generally rectangular source of electrical power 310 when the generally rectangular source of electrical power 310 is in the cavity of the light body 100, 100', 100", 100'''; or a first connector 330 for making electrical connection to a source of electrical power when a source of electrical power 310 is in the light body 100, 100', 100", 100''' and a second connector 130 for making electrical connection to an external electrical power source for charging the generally rectangular source of electrical power 310 when the generally rectangular source of electrical power 310 is in the cavity of the light body 100, 100', 100", 100'''. The tubular lens 240, 240*a*, 240*b*: may be captive on cylindrical member 210; or may include one or more color filters, a polarizing filter, and/or a diffusing filter; or may include one or more color filters, a polarizing filter, and/or a diffusing filter and be captive on cylindrical member 210. The generally cylindrical light head 200 may include a cylindrical member 210 comprising a thermally conductive metal or a thermally conductive non-metal. The switch 250 may be an electrical switch 350 disposed on an electronic circuit board 320 in light body 100, 100', 100", 100''' and may be actuated by a switch actuator 250 on body 100, 100', 100", 100'''. The electronic circuit board 320 may be disposed adjacent a source of electrical power 310 when the source of electrical power 310 is disposed in the cavity of light body 100, 100', 100", 100'''. The light body 100, 100', 100", 100''' may have a feature 140, 140' for receiving an attachment device 146 thereon, and the portable light 10, 10', 10", 10''' may further comprise an attachment device 146 for attaching the portable light 10, 10', 10", 10''' to a person and/or object. The attachment device 146 may comprise: a band 146*b*, a strap 146*b*, a clip 146*b*, a slip-on clip 146*c*, a snap-on clip 146*c*, a hook and loop fastener 146*f*, or a fastener 146.

A portable light 10, 10', 10", 10''' may comprise: a generally rectangular light body 100, 100', 100", 100''' having a pair of opposing spaced apart extensions 120, 120', 120", 120''' thereon, the light body 100, 100', 100", 100''' having a cavity for receiving a generally rectangular battery 310 therein; a generally cylindrical light head 200 rotatably supported adjacent the light body 100, 100', 100", 100' between the extensions 120, 120', 120", 120''' thereof; a light source 230 in the generally cylindrical light head 200 for producing light; a knob 220 for rotating the generally cylindrical light head 200; the generally cylindrical light head 200 including at least one lens 214, 240, 240*a*, 240*b* through which light produced by the light source 230 passes; a switch 250 for selectively actuating the light source 230 to produce light; and a generally rectangular battery 310 in the cavity of the generally rectangular light body 100, 100', 100", 100''' for selectively providing electrical power to the light source 230 responsive to the switch 250. The generally cylindrical light head 200 may be located: adjacent an end of light body 100, 100', 100", 100'''; or adjacent a broad surface of light body 100, 100', 100", 100'''; or adjacent a broad surface of light body near an end of light body 100, 100', 100", 100'''. The cylindrical light head 200 may be rotatable more than 360° wherein: generally cylindrical light head 210 includes at least one circular electrical contact 244; and light body 100, 100', 100", 100''' includes at least one fixed electrical contact 344 adjacent the circular electrical contact 244 of generally cylindrical light head 200 for providing at least one electrical slip ring 340 connection therebetween. The generally cylindrical light head 200 may include a cylindrical member 210 and a curved lens 240, 240*a*, 240*b* slidable along cylindrical member 210 and captive adjacent thereto. The curved lens 240, 240*a*, 240*b* may include one or more slidable curved lenses 240, 240*a*, 240*b*, each slidable curved lens 240, 240*a*, 240*b* being shorter than cylindrical member 210 and having a different optical property than another slidable curved lens 240, 240*a*, 240*b*. The curved lens 240, 240*a*, 240*b* may include one or more color filters, a polarizing filter, and/or a diffusing filter. The source of electrical power 310, 310' may include a rechargeable battery 310, 310', and portable light 10, 10', 10", 10''' may further include: a charging connector 130 on light body 100, 100', 100", 100''' electrically coupled to the rechargeable battery 310, 310' for charging the rechargeable battery; or a USB compatible charging connector 130 on light body 100, 100', 100", 100' electrically coupled to the rechargeable battery 310, 310' for charging the rechargeable battery. Switch 250 may comprise a switch actuator 250 on generally rectangular light body 100, 100', 100", 100''' and an electrical switch 350 on an electronic circuit board 320 in light body 100, 100', 100", 100''' and actuatable by switch actuator 250. Light body 100, 100', 100", 100''' may have a feature 140, 140' for receiving an attachment device 146 thereon, portable light 10, 10', 10", 10''' further comprising an attachment device 146 for attaching portable light 100, 100', 100", 100''' to a person and/or to an object.

A portable light 10, 10', 10", 10''' may comprise: a generally rectangular light body 100, 100', 100", 100''' having a pair of opposing spaced apart projections thereon, light body 100, 100', 100", 100''' having a generally rectangular cavity for receiving a source of electrical power therein; a generally cylindrical light head 200 rotatably supported adjacent light body 100, 100', 100", 100''' between the projections 120, 120', 120", 120''' thereof, light head 200 including a light source 230 for producing light; a switch 250 for selectively actuating light source 230; a plurality of electrical conductors providing electrical contacts in the generally rectangular cavity of light body 100, 100', 100", 100''', wherein the electrical contacts are arranged to receive interchangeably a generally rectangular battery 310 or a plurality of cylindrical batteries 310; and a source of electrical power 310, 310' in the generally rectangular cavity of light body 100, 100', 100", 100''' including interchangeably a generally rectangular battery 310 having terminals for connecting to the electrical contacts and a plurality of cylindrical batteries 310' having terminals for connecting to the electrical contacts. The generally cylindrical light head 200 may be located: adjacent an end of light body 100, 100', 100", 100'; or adjacent a broad surface of light body 100, 100', 100", 100'''; or adjacent a broad surface of light body near an end of light body 100, 100', 100", 100'''. The cylindrical light head 200 may be rotatable more than 360° wherein: generally cylindrical light head 210 includes at least one circular electrical contact 244; and light body 100, 100', 100", 100''' includes at least one fixed electrical contact 344 adjacent the circular electrical contact 244 of generally cylindrical light head 200 for providing at least one electrical slip ring 340 connection therebetween. The generally cylindrical light head 200 may include a cylindrical member 210 and a curved lens 240, 240*a*, 240*b* slidable along cylindrical member 210 and captive adjacent thereto. The curved lens 240, 240*a*, 240*b* may include one or more slidable curved lenses 240, 240*a*, 240*b*, each slidable curved lens 240, 240*a*, 240*b* being shorter than cylindrical member 210 and having a different optical property than another slidable curved lens 240, 240*a*, 240*b*. The curved lens 240, 240*a*, 240*b* may include one or more color filters, a polarizing filter, and/or a diffusing filter. The source of electrical power 310, 310' may include a rechargeable battery 310, 310', and portable light 10, 10', 10", 10''' may further include: a charging connector 130 on light body 100, 100', 100", 100''' electrically coupled to the rechargeable battery 310, 310' for charging the rechargeable battery; or a USB compatible charging connector 130 on light body 100, 100', 100", 100''' electrically coupled to the rechargeable battery 310, 310' for charging the rechargeable battery. Switch 250 may comprise a switch actuator 250 on generally rectangular light body 100, 100', 100", 100''' and an electrical switch 350 on an electronic circuit board 320 in light body 100, 100', 100", 100''' and actuatable by switch actuator 250. Light body 100, 100', 100", 100''' may have a feature 140, 140' for receiving an attachment device 146 thereon, portable light 10, 10', 10", 10''' further comprising an attachment device 146 for attaching portable light 100, 100', 100", 100''' to a person and/or to an object.

As used herein, the term "about" means that dimensions, sizes, formulations, parameters, shapes and other quantities and characteristics are not and need not be exact, but may be approximate and/or larger or smaller, as desired, reflecting tolerances, conversion factors, rounding off, measurement error and the like, and other factors known to those of skill in the art. In general, a dimension, size, formulation, parameter, shape or other quantity or characteristic is "about" or "approximate"whether or not expressly stated to be such. It is noted that embodiments of very different sizes, shapes and dimensions may employ the described arrangements.

Although terms such as "up," "down," "left," "right," "front," "rear," "side," "top," "bottom," "forward," "backward," "under" and/or "over," and the like may be used herein as a convenience in describing one or more embodiments and/or uses of the present arrangement, the articles described may be positioned in any desired orientation and/or may be utilized in any desired position and/or orientation. Such terms of position and/or orientation should be understood as being for convenience only, and not as limiting of the invention as claimed.

Further, what is stated as being "optimum" or "deemed optimum" may or may not be a true optimum condition, but is the condition deemed to be desirable or acceptably "optimum" by virtue of its being selected by the designer and/or in accordance with the decision rules and/or criteria defined by the applicable controlling function, e.g., the placing of a rectangular battery 310 in the like sized rectangular battery cavity of the rectangular housing 100, 100', 100", 100''' leads to at least a near optimum utilization of the volume of housing 100, 100', 100", 100''' particularly when a thin planar electronic circuit board 320 with low profile electronic components thereon is disposed adjacent battery 310 as shown.

The term battery is used herein to refer to an electrochemical device comprising one or more electro-chemical cells and/or fuel cells, and so a battery may include a single cell or plural cells, whether as individual units or as a packaged unit. A battery is one example of a type of an electrical power source suitable for a portable device.

While the present invention has been described in terms of the foregoing example embodiments, variations within the scope and spirit of the present invention as defined by the claims following will be apparent to those skilled in the art. For example, light head 200 may be positioned at any location of light body 100, 100', 100", 100''' as may be desired, and various features such as connector 130 or switch actuator 250 may be necessary or convenient for cooperating with electronic circuitry internal to light 10, 10', 10", 10'''.

Switch actuator 250 may be in any convenient location of light 10, 10', 10", 10''', e.g., on a knob 220 thereof, at an end of cylindrical member distal knob 220, or on any convenient surface of light body 100, 100', 100", 100''' thereof, as may be convenient for controlling an electronic circuit 300 disposed internal to light 10, 10', 10", 10'''. One alternative location for a switch or actuator 250 could be on the larger broad surface of light body 100, 100', 100", 100''' which would be considered the "top" when light body 100, 100', 100", 100''' is placed upon a horizontal surface.

Lenses 240, 240*a*, 240*b* are adjacent to cylindrical member 210 and slide along that member 210, so as to be slidable to a position in front of lens 214 and LED 230 to filter the light emanating therefrom. Lenses 240, 240*a*, 240*b* may be tubular (e.g., cylindrical) and surround cylindrical member 210, or may be a portion of a cylinder or tube, e.g., a semi-cylinder or a U-shape, so as to be movable in front of the portion of cylindrical member 210 that is exposed, e.g., visible externally to light 10, 10', 10", 10'''. Lenses 240, 240*a*, 240*b* may have a rib, groove, ridge or tab 242, 242*a*, 242*b* or other feature against which a user's finger or fingernail or a tool may be placed to assist in sliding lenses 240, 240*a*, 240*b* from one position to another along cylindrical member 210.

Optional guides 140' may be parallel raised features as illustrated or may be of another shape and/or size, e.g., raised posts or recessed depressions. Guides 140' may be located on any one or more surfaces of any of lights 10, 10', 10", 10''', e.g., on either a front or rear broader surface or on a narrower end or side surface, as may be convenient or desirable, e.g., for receiving a band 146*b*, strap 146*b*, clip 146*c*, slip-on clip 146*c*, snap-on clip 146*c*, hook and loop fastener 146*f*, or another fastener 146 or attachment device 146.

Where light 10, 10', 10", 10''' is configured to receive a rectangular battery 310 and cylindrical batteries 310' interchangeably, cavity 116, 116' of light body 100, 100', 100", 100''' may include various fixed and/or resilient projections 118' that define respective space configurations within cavity 116 to receive whichever battery a user may place therein. In such instance, cavity 116, 116' may also include electrical contacts 330 for making connection to the terminals 312 of the battery and/or batteries 310, 310' intended to be received therein.

Each of the U.S. Provisional Applications, U.S. Patent Applications, and/or U.S. Patents identified herein are hereby incorporated herein by reference in their entirety, for any purpose and for all purposes irrespective of how it may be referred to herein.

Finally, numerical values stated are typical or example values, are not limiting values, and do not preclude substantially larger and/or substantially smaller values. Values in any given embodiment may be substantially larger and/or may be substantially smaller than the example or typical values stated.

What is claimed is:

1. A rechargeable portable light comprising:

a generally rectangular light body having a generally rectangular cavity therein;

a generally rectangular rechargeable source of electrical power disposed in the cavity of said light body;

a light head supported by said light body, said light head including a light source for producing light, wherein said light head is movable relative to said light body for directing light in different directions;

a switch for selectively actuating said light source;

an electronic circuit board disposed between said rechargeable source of electrical power and a wall of said light body, said circuit board including an electronic circuit for controlling operation of said light source responsive to said switch; and a USB port on said light body for connecting to a source of charging power, said USB port connecting to said electronic circuit and to said rechargeable source of electrical power for charging said rechargeable source of electrical power.

2. The rechargeable portable light of claim 1 further comprising an attachment device for attaching said rechargeable portable light to a person and/or object.

3. The rechargeable portable light of claim 2 wherein said attachment device comprises: a band, a strap, a clip, a slip-on clip, a snap-on clip, a hook and loop fastener, or a fastener.

4. The rechargeable portable light of claim 1 further comprising:

a clip attached to said light body for attaching said rechargeable portable light to a person and/or object; or a clip attached to said light body for attaching said rechargeable portable light to a person and/or object, said clip having a keyhole shaped opening therein.

5. The rechargeable portable light of claim 1 wherein said light head is located:

adjacent an end of said light body; or adjacent a broad surface of said light body; or adjacent a broad surface of said light body near an end of said light body.

6. The rechargeable portable light of claim 1 wherein said switch includes:

an electrical switch interior said light body that is actuated by a switch actuator on said light body; or an electrical switch disposed on the electronic circuit board in said light body that is actuated by a switch actuator on said light body; or an electrical switch disposed on the electronic circuit board interior said light body that is actuated by a switch actuator on said light body.

7. The rechargeable portable light of claim 1 wherein said rechargeable source of electrical power includes:

a rechargeable battery; or a rechargeable lithium battery.

8. The rechargeable portable light of claim 1 wherein said light head includes:

a generally cylindrical light head rotatably supported adjacent the one surface of said light body between a pair of opposing spaced apart extensions thereof, wherein each opposing end of said generally cylindrical light head is rotatably supported by one of the spaced apart extensions of said light body, whereby said light head is rotatable relative to said light body for directing light in different directions.

9. A rechargeable portable light comprising:

a generally rectangular light body having a generally rectangular cavity therein;

a rechargeable source of electrical power disposed in the cavity of said light body;

a light head supported by said light body, said light head including a light source for producing light, wherein said light head is movable relative to said light body for directing light in different directions;

a switch for selectively actuating said light source;

an electronic circuit for controlling operation of said light source responsive to said switch; and a USB compatible connector on said light body electrically coupled for charging said rechargeable source of electrical power.

10. The rechargeable portable light of claim 9 further comprising an attachment device for attaching said rechargeable portable light to a person and/or object.

11. The rechargeable portable light of claim 10 wherein said attachment device comprises: a band, a strap, a clip, a slip-on clip, a snap-on clip, a hook and loop fastener, or a fastener.

12. The rechargeable portable light of claim 9 further comprising:

a clip attached to said light body for attaching said rechargeable portable light to a person and/or object; or a clip attached to said light body for attaching said rechargeable portable light to a person and/or object, said clip having a keyhole shaped opening therein.

13. The rechargeable portable light of claim 9 wherein said light head is located:

adjacent an end of said light body; or adjacent a broad surface of said light body; or adjacent a broad surface of said light body near an end of said light body.

14. The rechargeable portable light of claim 9 wherein said switch includes:

an electrical switch interior said light body that is actuated by a switch actuator on said light body; or an electrical switch of the electronic circuit that is actuated by a switch actuator on said light body.

15. The rechargeable portable light of claim 9 wherein said rechargeable source of electrical power includes:

a rechargeable battery; or a rechargeable lithium battery.

16. The rechargeable portable light of claim 9 wherein said light head includes:

a generally cylindrical light head rotatably supported adjacent the one surface of said light body between a pair of opposing spaced apart extensions thereof, wherein each opposing end of said generally cylindrical light head is rotatably supported by one of the spaced apart extensions of said light body, whereby said light head is rotatable relative to said light body for directing light in different directions.

17. The rechargeable portable light of claim 9 wherein said rechargeable source of electrical power includes:

a generally rectangular rechargeable battery in the generally rectangular cavity of said generally rectangular light body; or plural cylindrical rechargeable batteries side by side in the generally rectangular cavity of said generally rectangular light body; or a generally rectangular rechargeable battery and plural cylindrical rechargeable batteries interchangeable in the generally rectangular cavity of said generally rectangular light body.

18. A rechargeable portable light comprising:

a light body having a cavity therein;

a rechargeable source of electrical power disposed in the cavity of said light body;

a light head moveable relative to said light body including a light source supported by said light body for producing light;

a switch for selectively actuating said light source;

a USB compatible connector on said light body electrically coupled for charging said rechargeable source of electrical power; and a clip attached to said light body for attaching said rechargeable portable light to a person and/or object.

19. The rechargeable portable light of claim 18 wherein said clip has a keyhole shaped opening therein.

20. The rechargeable portable light of claim 18 wherein said light head is located:

adjacent an end of said light body; or adjacent a broad surface of said light body; or adjacent a broad surface of said light body near an end of said light body.

21. The rechargeable portable light of claim 18 wherein said switch includes an electrical switch interior said light body that is actuated by a switch actuator on said light body.

22. The rechargeable portable light of claim 18 further comprising an electronic circuit interior said light body connected to said light source and to said USB connector, said electronic circuit including:

an electrical switch that is actuated by a switch actuator on said light body for providing said switch; and an electrical connection between said USB compatible connector and said rechargeable source of electrical power for providing charging power received at the USB compatible connector thereto.

23. The rechargeable portable light of claim 18 wherein said rechargeable source of electrical power includes:

a rechargeable battery; or a rechargeable lithium battery.

24. The rechargeable portable light of claim 18 wherein said light head includes:

a generally cylindrical light head rotatably supported adjacent the one surface of said light body between a pair of opposing spaced apart extensions thereof, wherein each opposing end of said generally cylindrical light head is rotatably supported by one of the spaced apart extensions of said light body, whereby said light head is rotatable relative to said light body for directing light in different directions.

25. The rechargeable portable light of claim 18 wherein said light body is generally rectangular and has a generally rectangular cavity, and wherein said rechargeable source of electrical power includes:

a generally rectangular rechargeable battery in the generally rectangular cavity of said generally rectangular light body; or plural cylindrical rechargeable batteries side by side in the generally rectangular cavity of said generally rectangular light body; or a generally rectangular rechargeable battery and plural cylindrical rechargeable batteries interchangeable in the generally rectangular cavity of said generally rectangular light body.

* * * * *